US011168868B2

(12) United States Patent
Huang et al.

(10) Patent No.: US 11,168,868 B2
(45) Date of Patent: Nov. 9, 2021

(54) DECORATION

(71) Applicants: JOYIN INC., Tempe, AZ (US); SHANGHAI LE YOUNG ELECTRONIC COMMERCE Co., Ltd., Shanghai (CN)

(72) Inventors: Liang Huang, Chandler, AZ (US); Xiaofeng Wang, Chandler, AZ (US)

(73) Assignees: JOYIN INC., Tempe, AZ (US); SHANGHAI LE YOUNG ELECTRONIC COMMERCE CO., LTD., Shanghai (CN)

( * ) Notice: Subject to any disclaimer, the term of this patent is extended or adjusted under 35 U.S.C. 154(b) by 0 days.

(21) Appl. No.: 16/944,870

(22) Filed: Jul. 31, 2020

(65) Prior Publication Data

US 2021/0033262 A1 Feb. 4, 2021

(30) Foreign Application Priority Data

Jul. 31, 2019 (CN) ..... 201910699557.1

(51) Int. Cl.
*F21V 33/00* (2006.01)
*F21V 3/02* (2006.01)
(Continued)

(52) U.S. Cl.
CPC ..... *F21V 11/00* (2013.01); *F21V 23/003* (2013.01); *F21V 33/0052* (2013.01); *F21V 21/08* (2013.01); *F21Y 2115/10* (2016.08)

(58) Field of Classification Search
CPC ..... F21V 11/00; F21V 21/08; F21V 33/0052; F21V 23/003
See application file for complete search history.

(56) References Cited

U.S. PATENT DOCUMENTS 2,592,444 A * 4/1952 Matelena ..... G09F 21/10 353/13
6,439,723 B1 * 8/2002 Tano ..... G03B 21/00 353/15
(Continued)

FOREIGN PATENT DOCUMENTS

CN 101038072 A 9/2007
CN 202140959 U 2/2012
(Continued)

OTHER PUBLICATIONS

Office Action issued to CN Application 201910699557A dated Jun. 2, 2021, along with English translation of the Search Report.

*Primary Examiner* — Arman B Fallahkhair

(57) ABSTRACT

A decoration is disclosed, which includes: a light source emitting light in at least two directions; a transmission member having an eyeball pattern; and a projection member; the light emitted by the light source in at least two directions passes through the transmission member, and projects the eyeball pattern onto at least two positions on the projection member. Another disclosed decoration includes: two sets of light sources, each set of light sources emitting light in at least two directions; two transmission members, each transmission member having an eyeball pattern; and two projection members; the light emitted by each set of the light sources in at least two directions passes through the transmission member, and projects the eyeball pattern onto at least two positions on the projection member. The decoration has simple structure and diverse functions, and produces a visual effect of moving eyeballs by means of projection for decoration applications.

18 Claims, 4 Drawing Sheets

(51) Int. Cl.

| | |
|---|---|
| ***F21V 11/00*** | (2015.01) |
| ***F21V 23/00*** | (2015.01) |
| *F21V 21/08* | (2006.01) |
| *F21Y 115/10* | (2016.01) |

(56) References Cited

U.S. PATENT DOCUMENTS

| | | | | |
|---|---|---|---|---|
| 7,077,553 | B2 * | 7/2006 | Vanderschuit | A63H 27/10 362/253 |
| 7,611,396 | B2 * | 11/2009 | Schnuckle | A63H 27/10 348/744 |
| 8,297,756 | B2 * | 10/2012 | Ouyang | G03B 21/64 353/43 |
| 9,949,346 | B2 * | 4/2018 | Patton | F21S 10/043 |
| 10,067,412 | B2 * | 9/2018 | Somashankarappa | G03B 23/105 |
| 2020/0099895 | A1 * | 3/2020 | Chien | F21S 9/022 |

FOREIGN PATENT DOCUMENTS

| | | | |
|---|---|---|---|
| CN | 102444790 | A | 5/2012 |
| JP | 2015118764 | A | 6/2015 |
| TW | I263006 | B | 10/2006 |

* cited by examiner

DECORATION

CROSS-REFERENCE TO RELATED APPLICATIONS

The present application claims the priority to Chinese Patent Application No. 201910699557.1, titled "DECORATION", filed with the China National Intellectual Property Administration on Jul. 31, 2019, which is incorporated herein by reference in its entirety.

RELATED FIELD

The present disclosure relates to articles for daily use, and in particular to a decoration.

BACKGROUND

At present, most of eye-like decorative lights on the market are provided in such a manner that: light emitted by a light source is irradiated on a covering, and depending on the shape of the covering, the decorative light looks like an eye with a certain form.

For some eye-like decorative lights, by changing the shape of the covering, the decorative light can look like an eye with different forms and produce some special effects such as the effect of blinking.

However, the structures of these eye-like decorative lights are complicated and the functions thereof are simple.

The decorative lights need to be improved based on new requirements.

SUMMARY

In order to solve the above problems of the above existing decorations, the present disclosure provides a new-type decoration with a simple structure and diverse functions.

According to an aspect of the present disclosure, a decoration is provided. The decoration includes: a light source configured to be capable of emitting light in at least two directions; a transmission member having an eyeball pattern; and a projection member; wherein the light emitted by the light source in at least two directions passes through the transmission member, and projects the eyeball pattern onto at least two positions on the projection member.

In an alternative embodiment, the light source is configured to be capable of emitting light in two directions, and the light emitted by the light source in two directions passes through the transmission member and projects the eyeball pattern onto two positions on the projection member.

In an alternative embodiment, the light source includes two point light sources, and the two point light sources are capable of emitting the light in two directions.

In an alternative embodiment, the point light source is an LED light.

In an alternative embodiment, the decoration includes a housing; the housing is provided with a cavity; the light source is arranged at a bottom of the cavity; the projection member is arranged at an opening of the cavity; and the transmission member is arranged in the cavity.

In an alternative embodiment, the decoration further includes an electronic control element configured to control a light-emitting mode of the light source.

In an alternative embodiment, the electronic control element is further configured to produce a sound effect.

In an alternative embodiment, the decoration further includes a rear cover for accommodating the electronic control element, and the rear cover is arranged on the housing.

In an alternative embodiment, the projection member is hemispherical.

In an alternative embodiment, the decoration further includes a decorative eyelash member rotatably arranged on a periphery of the projection member.

According to another aspect of the present disclosure, a decoration is provided. The decoration includes: two sets of light sources, each set of light sources being configured to be capable of emitting light in at least two directions; two transmission members, each transmission member having an eyeball pattern; and two projection members; wherein the light emitted by each set of the light sources in at least two directions passes through the corresponding transmission member, and projects the eyeball pattern onto at least two positions on the corresponding projection member.

In an alternative embodiment, each set of the light sources is configured to be capable of emitting light in two directions, and the light emitted by each set of the light sources in two directions passes through the corresponding transmission member and projects the eyeball pattern onto two positions on the corresponding projection member.

In an alternative embodiment, the decoration includes a housing; the housing is provided with two cavities; each set of the light sources is arranged at a bottom of the corresponding cavity; each projection member is arranged at an opening of the corresponding cavity; and each transmission member is arranged in the corresponding cavity.

In an alternative embodiment, the decoration further includes an electronic control element configured to control a light-emitting mode of each set of the light sources.

In an alternative embodiment, the electronic control element is further configured to produce sound effects.

The decoration according to the present disclosure has a simple structure and diverse functions. The decoration produces a visual effect of moving eyeballs by means of projection for decoration applications. The decoration can be used as an eye-like decoration during Halloween, and can also be used on other products to produce this dynamic effect.

From the following detailed description of the preferred embodiments in conjunction with the accompanying drawings, the above and other advantages and features will become clear and easy to understand.

BRIEF DESCRIPTION OF THE DRAWINGS

For more complete understanding of the present disclosure, reference should be made to the embodiments shown in more detail in the drawings and described below by way of examples of the present disclosure, wherein.

DETAILED DESCRIPTION

It is conceivable by those of ordinary skill in the art that, various features of the embodiment shown and described with reference to any drawing may be combined with features shown in one or more other drawings to form other embodiments not explicitly shown or described. The combinations of shown features provide representative embodiments for typical applications. However, for specific applications or implementations, various combinations and modifications of features may be made according to the teaching of the present disclosure.

In this specification, directional terms such as "up", "down", "left", and "right" are only for ease of expression, not for limitation.

Figure 1:
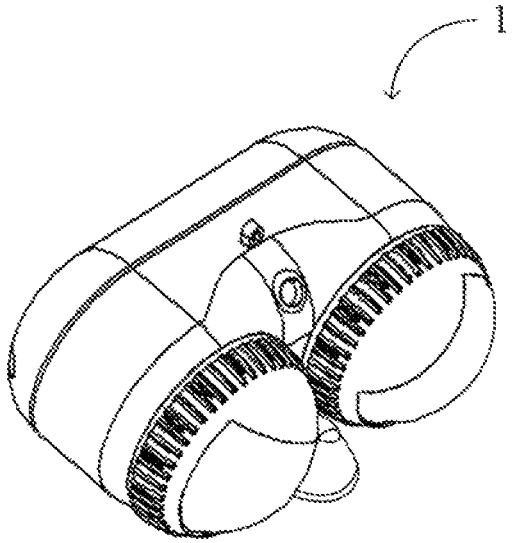
FIG. 1 is a schematic structural perspective view of a decoration according to an embodiment of the present disclosure.
Figure 2:
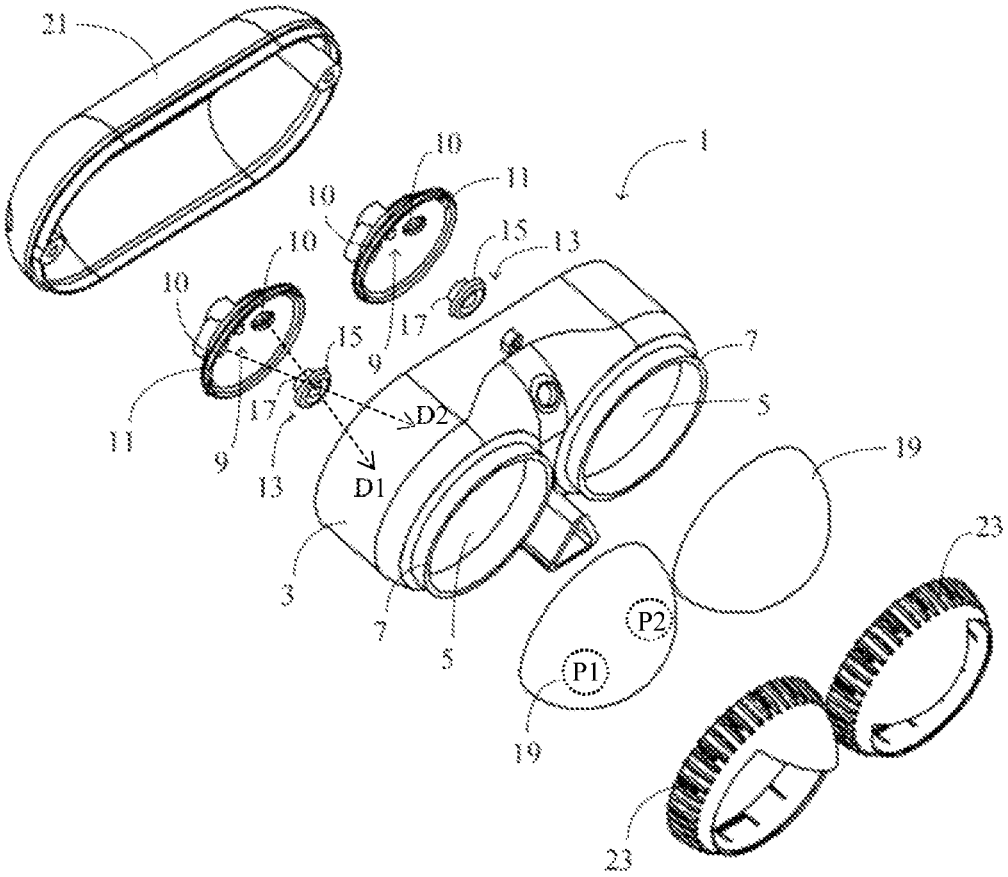
FIG. 2 is a schematic structural exploded view of the decoration in FIG. 1.

FIG. 1 is a schematic structural perspective view of a decoration 1 according to an embodiment of the present disclosure. FIG. 2 is a schematic structural exploded view of the decoration in FIG. 1. As shown in FIGS. 1 and 2, the decoration 1 includes a housing 3, and the housing 3 is provided with two cavities 5. Those two cavities 5 are substantially hemispherical. The top of each cavity 5 has a circular opening 7.

A light source 9 is provided at the bottom of each cavity 5. The light source 9 can emit light in two directions. In the illustrated embodiment, the light source 9 includes two point light sources. More specifically, the point light source is an LED light 10. It is conceivable that the light source 9 may emit light in two directions by other means.

In the illustrated embodiment, the decoration 1 further includes two light source holders 11. These two light source holders 11 are installed at the bottoms of the two cavities 5 of the housing 3 respectively. Two LED lights 10 are provided on each light source holder 11. That is, the LED light 10 is provided at the bottom of the corresponding cavity 5 by means of the light source holder 11. It is conceivable that the light source holder 11 may not be provided, and the LED light may be directly provided at the bottom of the corresponding cavity 5.

The decoration 1 further includes two transmission members 13 which are respectively arranged in the two cavities 5 of the housing 3. Specifically, each transmission member 13 includes a plate-like portion 15 and a mounting portion 17. The mounting portion 17 of the transmission member 13 is mounted to the light source holder 11 and is located between the two LED lights 10. The plate-like portion 15 is transversely arranged with respect to the mounting portion 17. The plate-like portion 15 has an eyeball pattern. The transmission member 13 allows the light emitted by the LED light 10 to pass therethrough.

The decoration 1 further includes two projection members 19 which are arranged at the openings 7 of the two cavities 5 of the housing 3 respectively. The periphery of each projection member 19 is connected to the periphery of the opening 7 of the corresponding cavity 5. In the illustrated embodiment, each projection member 19 has a hemispherical shape, which is similar to the surface of an eye. It is conceivable that, the projection member 19 may protrude more or less compared to the hemispherical shape. The projection member 19 may be a plane.

Referring to FIG. 2, the light emitted from the two LED lights 10 passes through the transmission member 13 in two directions D1, D2, such that the eyeball pattern on the transmission member 13 is projected by the two LED lights 10 onto two positions P1, P2 on the projection member 19. Since the transmission member 13 is located between the two LED lights 10, the light emitted from the LED light 10 located on one side of the transmission member 13 would pass through the transmission member 13 such that the eyeball pattern is projected by the LED light 10 onto a position on the projection member 19 on the other side of the transmission member 13. Specifically, the light emitted from the LED light 10 located on the right side of the transmission member 13 would pass through the transmission member 13 in a first direction D1 such that the eyeball pattern of the transmission member 13 is projected by the right LED light 10 onto a first position P1 on the projection member 19 on the left side of the transmission member 13. Correspondingly, the light emitted from the LED light 10 located on the left side of the transmission member 13 would pass through the transmission member 13 in a second direction D2 such that the eyeball pattern of the transmission member 13 is projected by the left LED light 10 onto a second position P2 on the projection member 19 on the right side of the transmission member 13. As the two LED lights 10 are alternately turned on, the eyeball pattern projected on the projection member 19 alternates between the two positions P1 P2, thus producing the effect of an eye looking left and right and moving left and right. The transmission member 13 may have different colors, so that the eyeball pattern projected onto the projection member 19 may have different colors as well. Thereby, the effect of colored eyeballs moving left and right can be produced.

The decoration 1 further includes an electronic control element (not shown). The electronic control element may include a printed circuit board and various electronic components integrated thereon. The electronic control element can control the light-emitting modes of the light sources 9. One of the light-emitting modes may be that, the LED lights on the left side of the transmission members 13 in the two sets of light sources 9 are simultaneously turned on, and the eyeball pattern is thereby produced at a position on each projection member 19 on the right side of the corresponding transmission member 13; and then the LED lights on the right side of the transmission members 13 in the two sets of light sources 9 are simultaneously turned on, and the eyeball pattern is thereby produced at a position on each projection member 19 on the left side of the corresponding transmission member 13; and the lights are continuously alternately turned on. Based on this light-emitting mode, the eyeball patterns projected on the two projection members 19 can continuously alternate between left and right sides, producing an effect of eyes alternately looking left and right. This effect, combined with the decorative effect of the decoration 1 itself, can produce interesting effect, which may be, for example, suitable for Halloween. It is conceivable that, the electronic control element may further control the light sources 9 to emit light in other light-emitting modes, thereby producing other visual effects.

In some embodiments, the electronic control element is further configured to produce sound effects. For example, the electronic control element can play songs or music. In a usage scenario suitable for Halloween, the electronic control element can play music that can produce interesting effects.

The electronic control element may be turned on and off by a switch, thereby controlling the visual effects of the eyeballs looking left and right and the sound effects. It is conceivable that the electronic control element may be turned on and off by other means. For example, the electronic control element may be turned on and off by means of voice control. When external sound reaches a certain decibel, the electronic control element is turned on. For example, the electronic control element may also be turned on and off by means of infrared sensing. For example, when it is sensed that a person is approaching, the electronic control element is turned on.

The decoration 1 further includes a rear cover 21 which is arranged on the housing 3. The rear cover 21 may accommodate the above-mentioned electronic control element. The rear cover 21 may further accommodate components such as power supplies. For the embodiment in which the electronic control element is turned on and off by a switch, the switch may be provided on the rear cover 21.

The decoration 1 further includes two decorative eyelash members 23, and each decorative eyelash member 23 is rotatably arranged on the periphery of the corresponding projection member 19. In some embodiments, the decorative eyelash member 23 may be fixedly arranged on the periphery of the projection member 19. The decorative eyelash member 23 may be directly provided on the housing 3. The rotatable decorative eyelash member 23 can cooperate with the eyeball to produce more visual effects.

It is conceivable that the above description of the embodiment of the decoration 1 is only exemplary, rather than restrictive. In the illustrated embodiment, the decoration 1 includes two eyes, that is, two eyes similar to the human's eyes. However, the decoration 1 may include only one eye or more than two eyes. Correspondingly, the decoration may include only one set of light sources or more than two sets of light sources; the decoration may include one or more than two transmission members; the decoration may include one or more than two projection members; and the decoration may include one or more than two decorative eyelash members.

In addition, the light source 9 may emit light in more than two directions. In this case, the light source 9 may project the eyeball pattern onto more than two positions on the projection member 19. In this way, based on various light-emitting modes, richer visual effects can be produced.

The connection method of the components of the decoration may be snapping connection, adhering connection, bolt connection and the like. For example, the rear cover 21 may be snapped to the housing 3; the transmission member 13 may be adhered to the light source holder 11; the light source holder 11 may be adhered to the housing 3; the projection member 19 may be adhered to the housing 3 or integrally formed with the housing 3; and the decorative eyelash member 23 may be snapped to the housing 3. It is conceivable that the components of the decoration may be connected to each other in a suitable method without being limited to the connection method described above.

Figure 3:
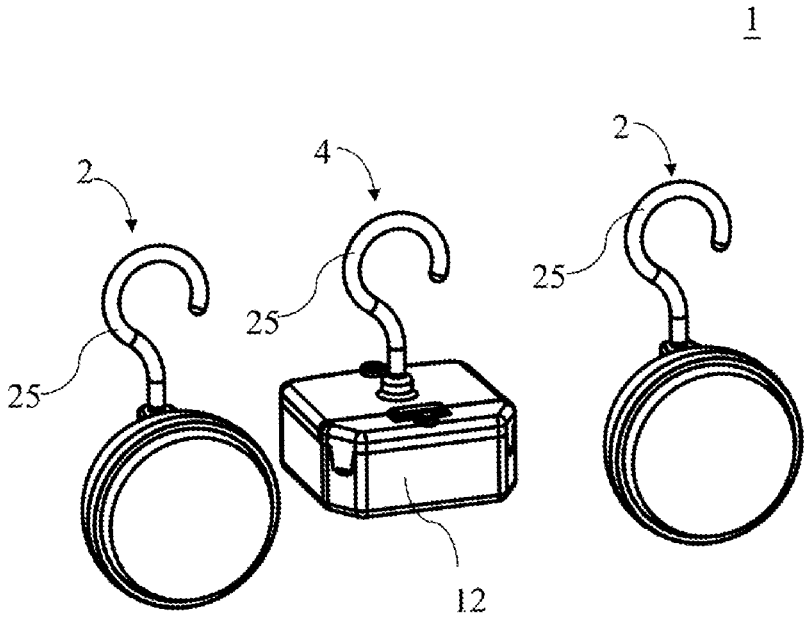
FIG. 3 is a schematic structural perspective view of a decoration according to another embodiment of the present disclosure.
Figure 4:
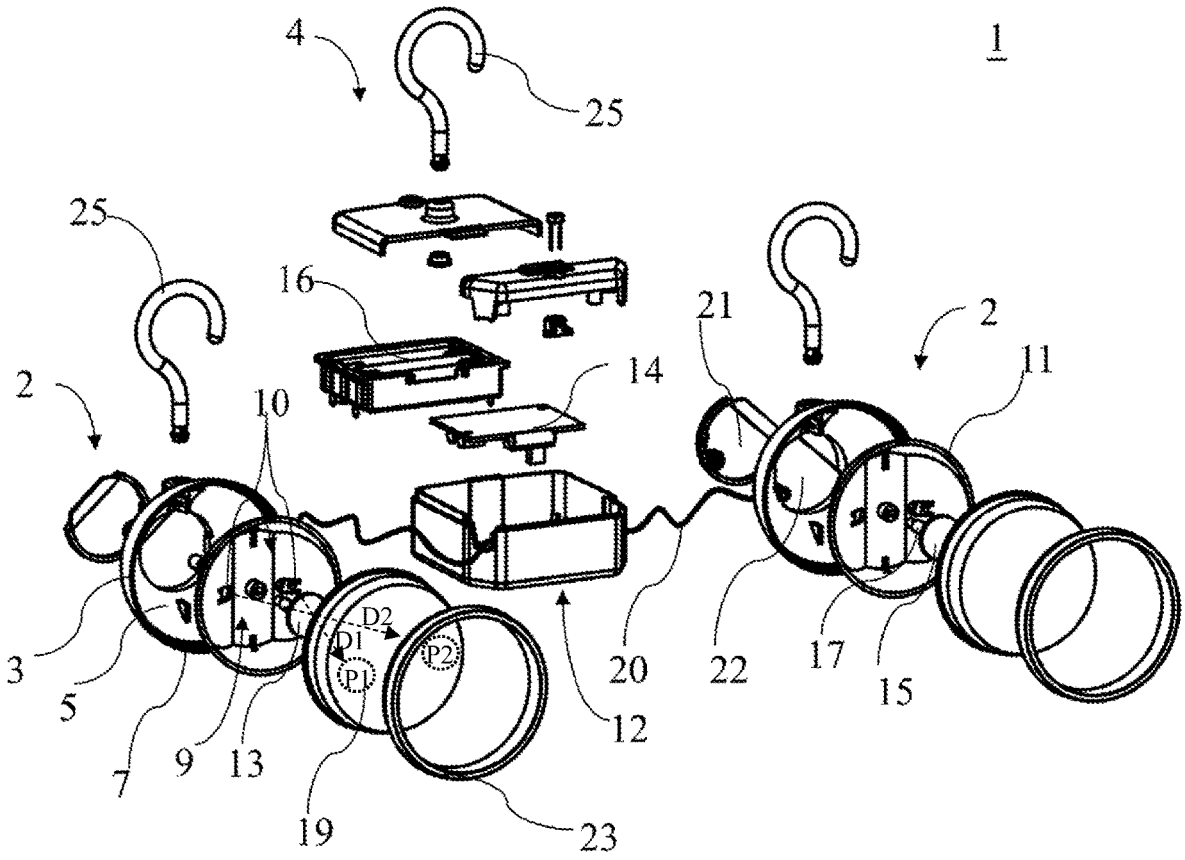
FIG. 4 is a schematic structural exploded view of the decoration in FIG. 3

FIG. 3 is a schematic structural perspective view of a decoration according to another embodiment of the present disclosure. FIG. 4 is a schematic structural exploded view of the decoration in FIG. 3. The main difference between the embodiment shown in FIG. 3 and the embodiment shown in FIG. 1 lies in that two eye assemblies of the decoration 1 shown in FIG. 3 are separated from each other. The following description mainly focuses on the difference between the two embodiments, and the similarities will not be described again.

As shown in FIG. 3 and FIG. 4, the decoration 1 includes two eye assemblies 2 and an electronic assembly 4.

Each eye assembly 2 may include a housing 3 which is provided with a cavity 5. The cavity 5 is substantially hemispherical. The top of the cavity 5 has a circular opening 7.

A light source 9 is provided at the bottom of each cavity 5. The light source 9 can emit light in two directions. In the illustrated embodiment, the light source 9 includes two LED lights 10.

Each eye assembly 2 further includes a light source holder 11 which is installed inside the cavity 5 of the housing 3. Two LED lights 10 are provided on the light source holder 11. That is, the LED light 10 is provided at the bottom of the cavity 5 by means of the light source holder 11.

Each eye assembly 2 further includes a transmission member 13 which is arranged in the cavity 5 of the housing 3. The transmission member 13 includes a substantially circular plate-like portion 15 and a mounting portion 17. The mounting portion 17 of the transmission member 13 is mounted to the light source holder 11 and is located between the two LED lights 10. The plate-like portion 15 is transversely arranged with respect to the mounting portion 17. The plate-like portion 15 has an eyeball pattern.

Each eye assembly 2 further includes a projection member 19 which is arranged at the opening 7 of the cavity 5 of the housing 3. The periphery of the projection member 19 is connected to the periphery of the opening 7 of the cavity 5. In the illustrated embodiment, the projection member 19 has a hemispherical shape.

As for each eye assembly 2, the light emitted from the two LED lights 10 passes through the transmission member 13 in two directions D1, D2, such that the eyeball pattern on the transmission member 13 is projected by the two LED lights 10 onto two positions P1, P2 on the projection member 19. Since the transmission member 13 is located between the two LED lights 10, the light emitted from the LED light 10 located on one side of the transmission member 13 would pass through the transmission member 13 such that the eyeball pattern is projected by the LED light 10 onto a position on the projection member 19 on the other side of the transmission member 13. Specifically, the light emitted from the LED light 10 located on the right side of the transmission member 13 would pass through the transmission member 13 in a first direction D1 such that the eyeball pattern of the transmission member 13 is projected by the right LED light 10 onto a first position P1 on the projection member 19 on the left side of the transmission member 13. Correspondingly, the light emitted from the LED light 10 located on the left side of the transmission member 13 would pass through the transmission member 13 in a second direction D2 such that the eyeball pattern of the transmission member 13 is projected by the left LED light 10 onto a second position P2 on the projection member 19 on the right side of the transmission member 13. As the two LED lights 10 are alternately turned on, the eyeball pattern projected on the projection member 19 alternates between the two positions P1 P2, thus producing the effect of an eye looking left and right and moving left and right.

It should be noted that, the eyeball pattern herein of the plate-like portion 15 of the transmission member 13 has a broad definition referring to the combination of the pattern, color, and/or transparency of the plate-like portion 15. The combination makes it possible that after the light emitted by the light source 9 travels towards the plate-like portion 15, an eyeball effect will be presented at a corresponding position on the projection member 19. For example, the plate-like portion 15 may be formed with a pattern and be transparent or translucent, and after the light emitted by the light source 9 passes through the plate-like portion 15, an effect of an eyeball with the pattern will be presented at a corresponding position on the projection member 19; the plate-like portion 15 may be colored (without pattern) and be transparent or translucent, and after the light emitted by the light source 9 passes through the plate-like portion 15, an effect of an eyeball with a solid color will be presented at a corresponding position on the projection member 19; or the plate-like portion 15 may be opaque, and the light traveling towards the plate-like portion 15 will be blocked, so that a shadow will be formed at a corresponding position on the projection member 19, thus presenting an effect of a dark or black eyeball.

Each eye assembly 2 further includes a decorative ring 23 which is rotatably arranged on the periphery of the projection member 19. The decorative ring 23 may be a decorative eyelash member in the embodiment shown in FIG. 1 or be in other suitable forms for decoration.

The decoration 1 further includes the electronic assembly 4. The electronic assembly 4 mainly includes a shell 12, an electronic control element 14 provided in the shell 12, a power supply (not shown), and a power supply container 16. In the illustrated embodiment, the shell 12 includes multiple shell portions assembled with each other. The electronic control element 14 may include a printed circuit board and various electronic components integrated thereon. The electronic control element 14 can control the light-emitting modes of the light sources 9 of the two eye assemblies 2. The power supply in the electronic assembly 4 is electrically connected to the light sources 9 in the eye assemblies 2 through wires 20 to supply power to the light sources 9.

Each eye assembly 2 further includes a rear cover 21 which is provided on the housing 3. An opening 22 is provided at the bottom of the housing 3, and the rear cover 21 covers part of the opening 22, so that the wire 20 can pass through the opening 22 to be electrically connected to the light source 9.

Each of the two eye assemblies 2 and the electronic assembly 4 includes a hook 25, so that the eye assemblies 2 and the electronic assembly 4 can be attached to the position to be decorated.

It is conceivable that the eye assembles 2 and the electronic assembly 4 may not have the hooks 25, but have other attachment components, such as straps, magnetic components, and adhesive components.

The connection manner of the components of the decoration 1 may be snapping connection, adhering connection, bolt connection and the like.

In the illustrated embodiment, the decoration 1 includes two eye assemblies. However, the decoration 1 may include only one eye assembly or more than two eye assemblies. Correspondingly, the decoration may include only one set of light sources or more than two sets of light sources, one or more than two transmission members, and one or more than two projection members.

Those skilled in the art will readily conclude from such discussions and from the drawings and claims that various changes and modifications can be made to the embodiments without departing from the true spirit and reasonable scope of the present disclosure defined by the appended claims.

The invention claimed is:

1. A decoration, comprising:

at least one eye assembly, each eye assembly comprising:

a light source comprising a first point light source and a second point light source;

one transmission member having an eyeball pattern; and a projection member;

wherein the light emitted by the first point light source and the second point light source passes through the transmission member in a first direction from the first point light source and a second direction from the second point light source such that the eyeball pattern is projected by the first and second point light sources onto a left position and a right position on the projection member, whereby the first point light source is turned on and off while the second point light source is simultaneously turned off and on such that the eye pattern projected on the projection member alternates between the left position and the right position, thus producing the effect of an eye moving left and right and then right and left.

2. The decoration according to claim 1, wherein the decoration further comprises an electronic control element configured to control a light-emitting mode of the light source.

3. The decoration according to claim 2, wherein the electronic control element is further configured to produce a sound effect.

4. The decoration according to claim 2, wherein the decoration further comprises a housing and a rear cover for accommodating the electronic control element, and the rear cover being arranged on the housing.

5. The decoration according to claim 2, wherein the electronic control element is configured to control the first point light source and the second point light source such that the point light sources are alternately turned on to make the eyeball pattern projected on the projection member to alternate between the left and right positions.

6. The decoration according to claim 1, wherein the light emitted by the first and second point light sources passes through the transmission member in the first direction and the second direction such that the eyeball pattern is projected by the first and second point light sources onto two positions on the projection member.

7. The decoration according to claim 1, wherein each point light source is an LED light.

8. The decoration according to claim 1, wherein the decoration comprises a housing, the housing is provided with a cavity, the light source is arranged at a bottom of the cavity, the projection member is arranged at an opening of the cavity, and the transmission member is arranged in the cavity.

9. The decoration according to claim 1, wherein the projection member is hemispherical.

10. The decoration according to claim 1, wherein the decoration further comprises a decorative eyelash member rotatably arranged on a periphery of the projection member.

11. A decoration, comprising:

two sets of light sources, each set of light sources comprising at least two point light sources;

two transmission members, each transmission member having an eyeball pattern; and two projection members;

wherein the light emitted by the at least two point light sources of each set of the light sources passes through a corresponding one of the two transmission members in at least two directions such that the eyeball pattern of the corresponding one transmission member is projected by the at least two point light sources onto at least two positions on a corresponding one projection member, the at least two point light sources projecting at a left position and at a right position on the projection member, whereby one point light source is turned on and off while the other point light source is simultaneously turned off and on such that the eye pattern projected on the projection member alternates between the left position and the right position, thus producing the effect of an eye moving left and right and then right and left.

12. The decoration according to claim 11, wherein the decoration further comprises an electronic control element configured to control a light-emitting mode of each set of the light sources.

13. The decoration according to claim 12, wherein the electronic control element is further configured to produce a sound effect.

14. The decoration according to claim 11, wherein the decoration comprises a housing, the housing is provided with two cavities, each set of the light sources is arranged at a bottom of the corresponding cavity, each projection member is arranged at an opening of the corresponding cavity, and each transmission member is arranged in the corresponding cavity.

15. The decoration according to claim 11, wherein each set of the light sources comprises two point light sources, and the light emitted by the two point light sources of each set of the light sources passes through a corresponding one of the two transmission members in two directions, such that the eyeball pattern of the corresponding one transmission member is projected by the two point light sources onto two positions on a corresponding one projection member.

16. A decoration, comprising:

an eye assembly comprising:

a light source comprising a first point light source and a second point light source;

a transmission member having an eyeball pattern; and a projection member;

wherein the light emitted by the first point light source and the second point light source passes through the transmission member in a first direction from the first point light source and a second direction from the second point light source, the first and second directions substantially intersecting in the transmission member, the eyeball pattern being projected by the first and second point light sources onto the projection member at first and second positions respectively, whereby the first point light source is turned on and off while the second point light source is simultaneously turned off and on such that the eye pattern projected on the projection member alternates between the left position and the right position, thus producing the effect of an eye moving left and right and then right and left.

17. The decoration according to claim 16, wherein each point light source is an LED light.

18. The decoration according to claim 16, wherein the decoration comprises a housing provided with a cavity wherein the light source is arranged at a bottom of the cavity, wherein the projection member is arranged at an opening of the cavity, and wherein the transmission member is arranged in the cavity.

* * * * *